US008479546B2

(12) United States Patent
Delande et al.

(10) Patent No.: US 8,479,546 B2
(45) Date of Patent: Jul. 9, 2013

(54) KEY HAVING A RETRACTABLE INSERT WITH IMPROVED MECHANICAL STRENGTH

(75) Inventors: Benoit Delande, Creteil Cedex (FR); Jean-Patrick Favier, Creteil Cedex (FR)

(73) Assignee: Valeo Securite Habitacle, Creteil (FR)

( * ) Notice: Subject to any disclaimer, the term of this patent is extended or adjusted under 35 U.S.C. 154(b) by 0 days.

(21) Appl. No.: 13/508,374

(22) PCT Filed: Nov. 19, 2010

(86) PCT No.: PCT/EP2010/067809
§ 371 (c)(1),
(2), (4) Date: Jul. 20, 2012

(87) PCT Pub. No.: WO2011/061279
PCT Pub. Date: May 26, 2011

(65) Prior Publication Data

US 2012/0285208 A1 Nov. 15, 2012

(30) Foreign Application Priority Data

Nov. 20, 2009 (FR) ..... 09 05597

(51) Int. Cl.
*A44B 15/00* (2006.01)

(52) U.S. Cl.
USPC ..... 70/456 R; 70/408

(58) Field of Classification Search
USPC ..... 70/408, 456 R
See application file for complete search history.

(56) References Cited

U.S. PATENT DOCUMENTS

| | | | | |
|---|---|---|---|---|
| 6,705,141 | B1 * | 3/2004 | Jacob et al. | 70/408 |
| 8,225,633 | B2 * | 7/2012 | Luo et al. | 70/456 R |
| 8,266,936 | B2 * | 9/2012 | Box et al. | 70/408 |
| 2009/0217722 | A1 | 9/2009 | Luo et al. | |
| 2011/0259064 | A1 * | 10/2011 | David et al. | 70/397 |

FOREIGN PATENT DOCUMENTS

| | | | |
|---|---|---|---|
| DE | 10 2006 036503 | A1 | 2/2008 |
| EP | 1 063 374 | A1 | 12/2000 |
| FR | 2 816 976 | A1 | 5/2002 |
| FR | 2 915 759 | A1 | 11/2008 |

OTHER PUBLICATIONS

International Search Report w/translation from PCT/EP2010/067809 dated Feb. 11, 2011 (6 pages).

* cited by examiner

*Primary Examiner* — Suzanne Barrett
(74) *Attorney, Agent, or Firm* — Osha Liang LLP

(57) ABSTRACT

The invention relates to a module for extending a retractable insert of a key, in particular for a motor vehicle, which is intended to be mounted in a casing for said key and which comprises an insert (5, 7), intended to be pivotably mounted relative to said casing (3) between an inoperative and an operative position, and comprising a bit (7) and a bit holder (5), which is pivotably mounted relative to said casing (3), and a mechanism for extending the insert (5, 7), which includes a push-button (19), and an elastic return element (23) for the insert (5, 7) consisting of a helical torsion spring, one end (23*a*) of which is connected to the insert (5, 7), in order to urge the insert (5, 7) by pivoting towards said operative position, when the push-button (19) is actuated. According to the invention, the push-button (19) comprises a projection (49) for holding the insert (5, 7) in the inoperative position and in the operative position, the mounting position of said projection being different from said inoperative and operative positions.

9 Claims, 4 Drawing Sheets

KEY HAVING A RETRACTABLE INSERT WITH IMPROVED MECHANICAL STRENGTH

Figure 1A:
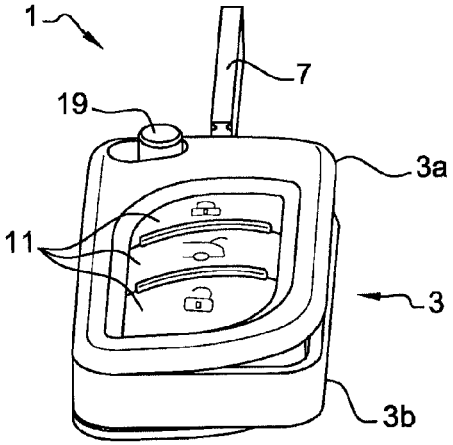

The invention relates to a module for deploying the insert of a key, notably for a motor vehicle, of which key the bow part comprises a casing and the part comprising the key bit, known as the insert, can be retracted into the casing.

Key structures that form a casing with a retractable mechanical insert have already been proposed and in these the insert is pivot-mounted between a position of rest in which the insert is retracted into a housing inside the casing, and a position of use in which the insert is deployed with respect to the casing.

Such an articulation of the insert entails an insert-deployment mechanism mounted inside the casing. For example, a deployment mechanism mounted between the bottom of one half-shell of the casing and a retaining wall of this half-shell and comprising:

- a yoke secured to the key bit and pivot-mounted in the casing about a pivot axis between the rest position and the position of use,
- a push button mounted in a housing of the yoke so as to pivot as one with the yoke, and
- a spring interposed between the bottom of the half-shell and the push button to return the yoke elastically to the position of use, is known.

However, this deployment mechanism uses a great many components which are also relatively bulky and may take over a large amount of space inside the casing.

Moreover, with such a mechanism it is impossible to obtain a push button for operating the deployment mechanism which is prevented from rotating with respect to the casing, in order to meet certain manufacturer requirements.

It is an object of the invention to provide an optimized deployment module in which the number of parts is limited while at the same time making it possible to obtain a push button that is prevented from rotating.

To this end, one subject of the invention is a module for deploying a retractable insert of a key, notably for a motor vehicle, intended to be mounted in a housing of said key, and comprising:

- an insert intended to be pivot-mounted with respect to said casing between a rest position in which the insert is retracted inside said casing and a position of use in which the insert is deployed with respect to said casing, and comprising a key bit and a key bit support secured to the key bit and pivot-mounted with respect to said casing,
- an insert deployment mechanism comprising a push button and an elastic return element for returning the insert consisting of a helical torsion spring, a first end of which is connected to the insert to urge the insert to pivot toward said position of use when the push button is actuated, characterized in that

- the push button comprises a means for blocking the rotation of the push button with respect to said casing forming a guide for the push button in axial translation,
- said return element is fixed to said push button by a second end,
- the first end of said return element is fixed to the key bit support in such a way that said return element urges said support to pivot to deploy the key bit when the push button is actuated, and

- said push button comprises a retaining projection for keeping the insert in the rest position and in the position of use, the position for mounting this projection being different than said rest position and position of use.

Thus there is obtained a module and, therefore, a key, having a reduced number of parts and a push button that is prevented from rotating and that operates the deployment mechanism.

Such a push button may additionally have any overall shape because it is not caused to turn.

Such a deployment module is assembled independently of a casing of the key in which the insert is intended to be retracted, and once assembled, this deployment module forms an entity that can easily be handled and mounted simply inside said casing.

Further, such a deployment module easily allows the return element to be preloaded during the assembly of this deployment module.

The fact that the mounting position for this module is different than the rest position and position of use of the insert means that the pressure force of the helical spring is maintained in the rest position and in the position of use with no load therefore being applied to the key casing during operation.

According to one preferred embodiment, said support comprises a collar with an opening through which said retaining projection passes in the mounting position.

For preference, said collar has two notches collaborating with said retaining projection such that said retaining projection engages with one of said notches in the rest position and with the other of said notches in the position of use and so that said retaining projection leaves said notch corresponding to the rest position when the push button is actuated, so as to allow said support to pivot.

The invention also relates to a key, notably for a motor vehicle, equipped with a such a deployment module, characterized in that it comprises said casing comprising an upper half-shell forming a cover and a lower half-shell forming the casing bottom, and said push button housed axially in an associated housing of the upper half-shell and projecting with respect to the upper half-shell so that it can be actuated by a user.

Figure 1B:
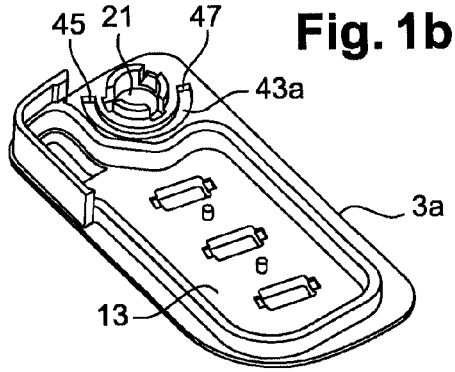
Figure 1C:
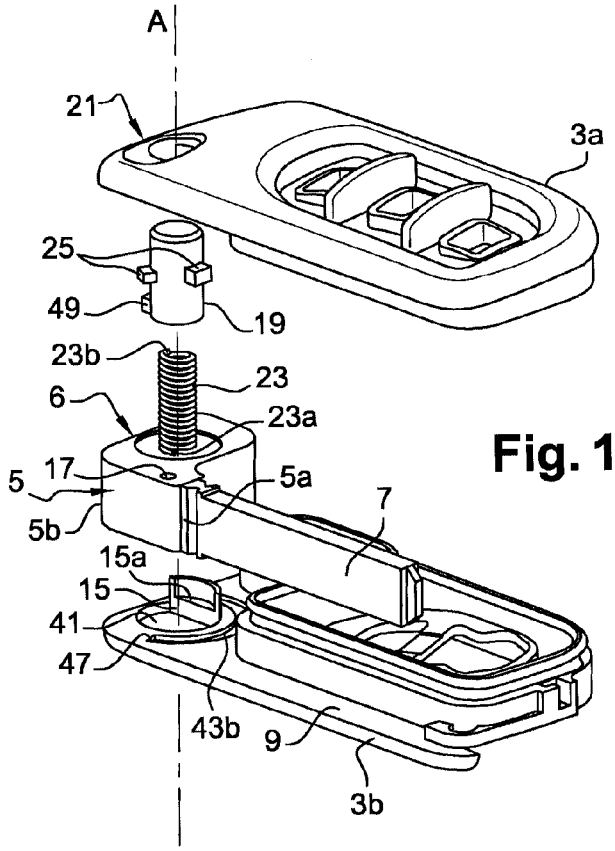
Figure 2:
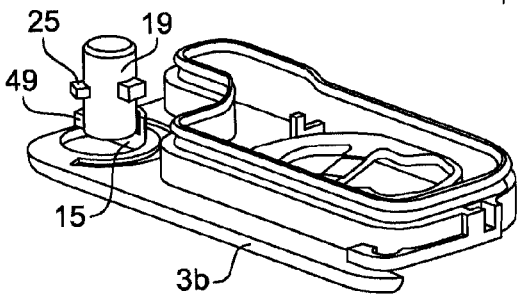
Figure 1D:
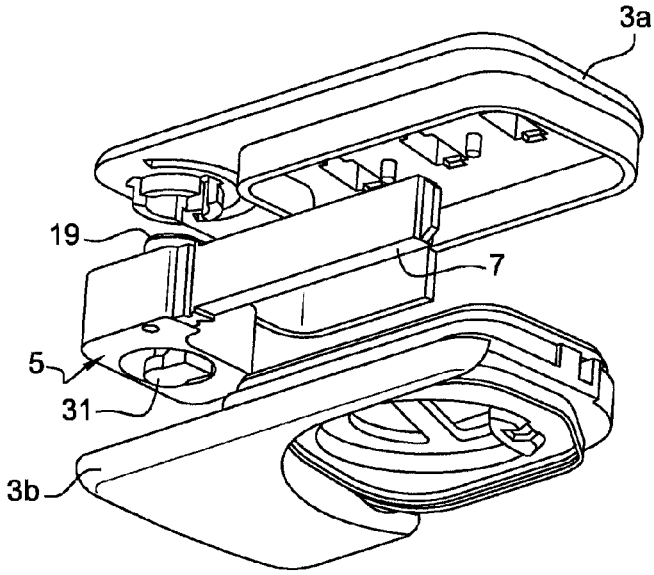
Figure 3A:
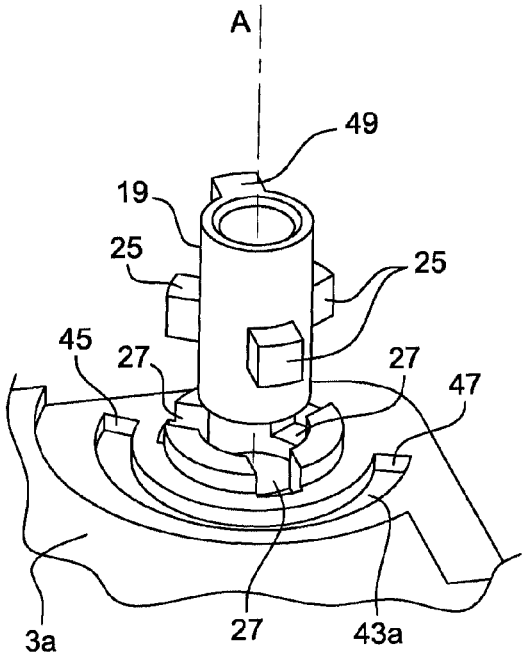
Figure 3B:
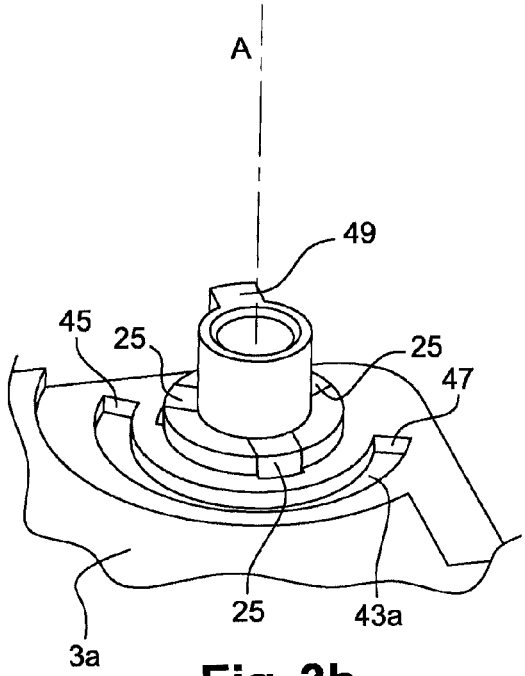
Figure 4A:
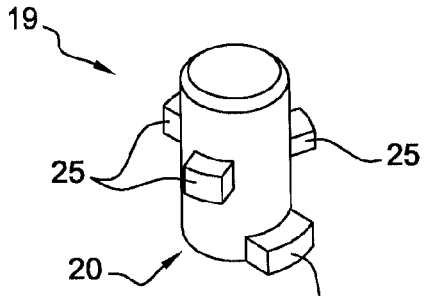
Figure 4B:
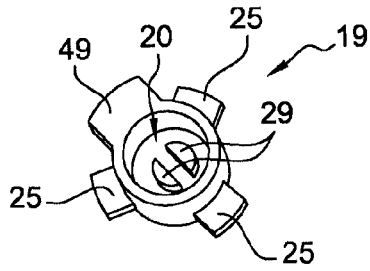
Figure 5A:
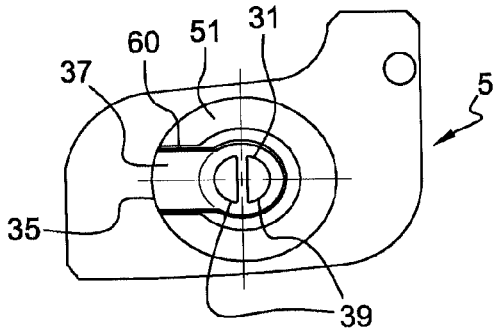
Figure 5B:
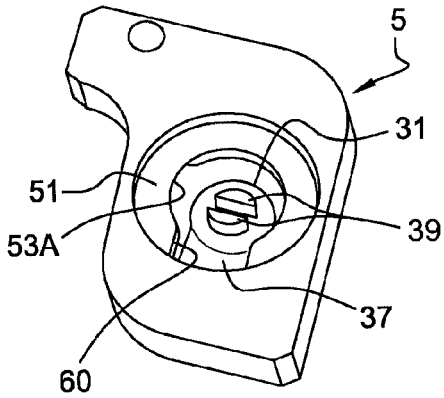
Figure 5C:
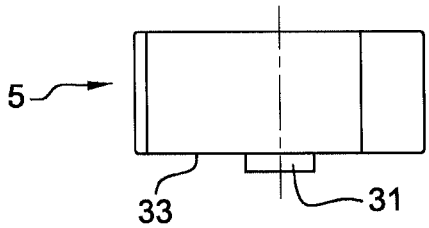
Figure 5D:
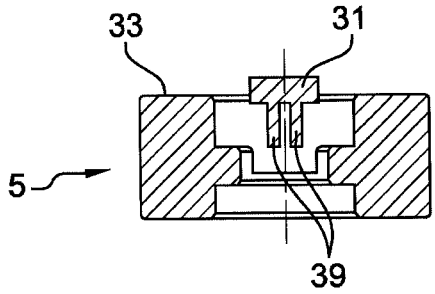
Figure 5E:
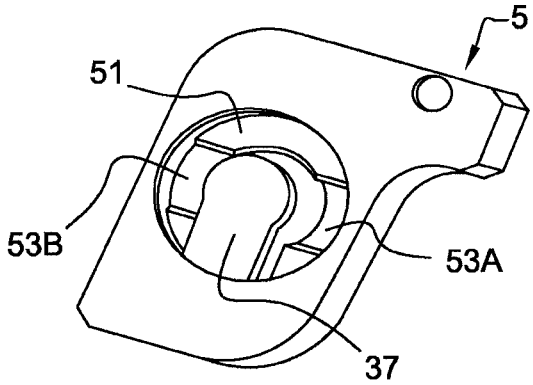

Other features and advantages of the invention will become more clearly apparent from reading the following description, given by way of illustrative and nonlimiting example, and from studying the attached drawings in which:

FIG. 1*a* depicts a key according to the invention,

FIG. 1*b* depicts the upper half-shell of the casing of the key of FIG. 1*a*, FIG. 1*c* depicts an exploded view of the key of FIG. 1*a*, FIG. 1*d* is a perspective view of FIG. 1*c* from beneath, FIG. 2 is a more detailed view of the lower half-shell and of the push button of the key of FIG. 1*a*, FIG. 3*a* is an exploded view of a push button and a push button housing on the upper half-shell of the casing of the key of FIG. 1*a*, FIG. 3*b* is a view of the push button mounted in the housing of FIG. 3*a*, FIG. 4*a* depicts a push button for the key of FIG. 1*a*, FIG. 4*b* is a view of the push button of FIG. 4*a* from beneath, FIG. 5*a* depicts a key bit support for the key of FIG. 1*a*, FIG. 5*b* is a view of the key bit support of FIG. 5*a*, from above, FIG. 5*c* is a side view of the key bit support of FIG. 5*a*, FIG. 5*d* is a view in cross section of the key bit support of FIG. 5*c*, and FIG. 5*e* is a partial side view of the key bit support of FIG. 5*a*.

The key 1 depicted in FIGS. 1*a* to 1*d* comprises:

a casing 3 following the bow of the key, an insert 5, 7 comprising a key bit support 5 and a key bit 7 as one with the support 5, and an deployment mechanism for deploying the insert 5, 7 with respect to the casing 3 to allow the insert 5, 7 to move between:

a rest position (FIGS. 1*c*, 1*d*) in which the insert 5, 7 is retracted into the casing 3 in a setback 9 provided inside the casing 3, for example in an approximate L shape corresponding to the shape of the insert 5, 7 and a position of use (FIG. 1*a*), in which the insert 5, 7 is deployed with respect to the casing 3 so that it can be inserted into a lock.

In the example illustrated, the casing 3 is made in two parts in the form of an upper half-shell 3*a* forming a cover and of a lower half-shell 3*b* forming a casing bottom, these two half-shells 3*a*, 3*b* being able to be assembled for example by clip-fastening. A seal (not depicted) may be positioned between the two half-shells 3*a*, 3*b* to protect the inside of the casing 3 against the external environment, particularly against moisture or dust. A decorative band (not depicted) may also be provided between the two half-shells 3*a*, 3*b* to make the assembly more attractive.

The key 1 may also combine a mechanical key with an electronic key. In that case, an electronic printed circuit board (not depicted) is positioned inside the casing 3. This board carries the electronic remote-control circuits for the central locking/unlocking of the doors of the vehicle, together with a transponder (not depicted) for the vehicle antitheft system and a battery (not depicted) to power the remote control function. This remote control function is actuated by the operator through actuating buttons 11 provided on the upper half-shell 3*a*.

Furthermore, the support 5 has two opposite ends 5*a*, 5*b*, of which the end 5*a* bears the key bit 7. For that, one end of the key bit 7 may be fitted into a complementary housing (not depicted) in the end 5*a* of the support 5. The support 5/key bit 7 assembly is kept fixed together for example by a pin (not depicted) passing through holes 17 made in the support 5 and in the key bit 7. Of course, the key bit 7 may be fixed to the support 5 by any other appropriate means.

Moreover, the insert 5, 7 deployment mechanism comprises:

a push button 19 housed in an associated housing 21 of the upper half-shell 3*a* and passing through an orifice 6 of the support 5, the push button 19 projecting with respect to the upper half-shell 3*a* so as to be accessible to a user so that he can operate this push button 19 in order to deploy the insert 5, 7, and an elastic return element 23 fixed by a first end 23*a* to the insert 5, 7 and by a second end 23*b* to an element that is prevented from rotating with respect to the casing 3, so as to urge the insert 5, 7 to pivot toward the position of use when the push button 19 is actuated. This return element 23 is a helical torsion spring.

When the push button 19 is actuated by the user, the push button 19 is made to effect an axial translational movement along the longitudinal axis A within the support 5.

To prevent the push button 19 from coming into abutment with the end wall of the support 5 at the end of its travel, a stop means that halts the push button 19 may be provided. This stop means may comprise a stop pad formed in the support 5 and with which the push button 19 comes into contact at the end of its travel so that the translational movement of the push button 19 is halted before this push button reaches the end wall of the support 5.

In the embodiment illustrated in FIGS. 1*c*, 1*d* and 2, support 5 has in its bottom a cavity (FIG. 1*d*), for example in an arc of a circle extending over more than 180°, and the stop means comprises a stop pad 15 (FIGS. 1*c* and 2) formed as an integral part of the lower half-shell 3*b* and which is inserted into the support 5 at this circular arc. This stop pad 15 additionally has a setback defining a surface 15*a* for contact with the push button 19 at the end of its travel. Further, the push button 19 comprises a rotation-preventing means that prevents the push button from rotating with respect to the casing 3. This rotation-preventing means forms a guide for the push button 19 in its axial translation along longitudinal axis A of the push button 19 and is made as one piece with the push button 19.

Thus, it is the push button 19 that both operates the deployment mechanism, guides the translational movement of the push button 19 and prevents the push button 19 from turning.

In the example illustrated, this guide-forming rotation-preventing means comprises at least one guide peg 25 which extends as a projection outward from the external surface of the push button 19. Provision may be made for the push button 19 to comprise two diametrically opposed guide pegs 25 or even three evenly distributed guide pegs 25 for optimized translational guidance.

With reference to FIGS. 3*a* and 3*b*, each guide peg 25 collaborates with a corresponding slot 27 made in the housing 21 on the upper half-shell 3*a* to guide the translational movement of the push button 19 with respect to the casing 3 along axis A and to prevent the push button 19 from rotating with respect to the casing 3.

Thus, given the height of the guide pegs 25 or first tenons and the additional thickness of the upper shell facing them, these tenons remain engaged in the slots 27 or first cavities and the button therefore remains prevented from rotating by connection with the upper shell.

The return element 23 itself is fixed by its second end 23*b* to the push button 19 which is thus stable in terms of rotation (FIG. 1*c*) without the need for any intermediate part between the push button 19 and the return element 23 of the deployment mechanism.

To this end, as may be seen from FIGS. 4*a* and 4*b*, the push button 19 has a hollow interior space 20 to house the second end 23*b* of the return element 23.

More specifically, two first parallel lips 29 are formed in the bottom of the push button 19 and extend toward the second end 23*b* of the return element 23 to house this second end 23*b*. In this case, the second end 23*b* extends in return inside the return element 23. The first lips 29 are thus able to immobilize the second end 23*b* with respect to the push button 19 and thus prevent the second end 23*b* from rotating with respect to the upper half-shell 3*a* of the casing 3.

Furthermore, in order to urge the insert 5, 7 to pivot, the return element 23 is preferably fixed by its first end 23*a* to the support 5.

Thus, the spring has its bottom end prevented from rotating on the insert yoke or support, inserted in a groove formed in the bottom thereof, and its upper end prevented from rotating in the bottom of the button, on the closed wall thereof. In said rest position, it is thus torsionally preloaded.

To achieve this, as may be seen from FIGS. 5*a*, 5*b*, the support 5 may comprise a hollow stud 31 to house the first end 23*a* of the return element 23 in the region of the bottom wall 33 of the support 5. This stud 31 is, for example, connected to an internal lateral wall 35 of the support 5 by a radial bridge of material 37 and may be formed as an integral part thereof.

In addition, two second parallel lips 39 may be provided, these being formed inside the peg 31 and extending toward the first end 23*a* of the return element 23 to house this first end 23*a*. The first end 23*a* likewise extends in return inside the return element 23. Thus, the second lips 39 immobilize the first end 23*a* with respect to the stud 31 of the support 5 pivot mounted with respect to the casing 3, so as to allow the return force of the return element 23 to be transmitted to the support 5.

Further, as FIGS. 5*c*, 5*d* illustrate, the stud 31 emerges from the bottom wall 33 of the support 5. An orifice 41 (FIG. 1*c*) is therefore provided on the internal wall of the lower half-shell 3*b* in the region of the setback 9 into which to fit the stud 31 when mounting the support 5 in the casing 3.

As described earlier (see FIGS. 1*c*, 1*d*), the support 5 is open in its bottom in an arc of a circle, into which the pad 15 is introduced when the support 5 is being mounted on the lower half-shell 3*b*. This circular arc is centered on the axis of pivoting A so that as the support 5 pivots, the stop pad 15 runs along this arc of a circle until the radial bridge of material 37 comes into abutment against this stop pad 15, thus blocking the pivoting movement of the support 5.

In addition, to guide the pivoting of the support 5, the support 5 may further comprise two guide fingers (not depicted) one on each side of the second end 5*b* and which, under the effect of actuation of the push button 19, are guided respectively in a first guide groove 43*a* formed in the upper half-shelf 3*a* and by a second guide groove 43*b* formed in the lower half-shell 3*b* (see FIGS. 1*b* and 1*c*). These guide grooves 43*a*, 43*b* have a semicircular overall shape and are each delimited by two stops 45, 47. Thus, when the guide fingers are against the stops 45, the insert 5, 7 is in the rest position, and when the guide fingers are against the stops 47, the insert 5, 7 is in the position of use.

Of course, any other means that provides the support 5 with guidance in its pivoting may be used.

Moreover, the push button 19 and the support 5 respectively fixed to the return element 23, collaborate in order to keep the insert 5, 7 in the rest position and in the position of use.

For that, with reference to FIGS. 4*a*, 4*b* and 5*b*, 5*e*, the push button 19 comprises a radial retaining projection 49 that keeps the insert 5, 7 in the rest position and in the position of use, and the support 5 comprises a collar 51. This collar 51 is open in the form of a passage 60 to allow the retaining projection 49 to pass in what is known as the mounting position, and on its underside has two notches 53A and 53B which are aligned and collaborate with the retaining projection 49 so that the retaining projection 49 engages with one of these notches 53A in the deployed, position of use, of the insert and with the other of these notches 53B in the retracted, rest position, of the insert and leaves these notches 53A, 53B when the push button 19 is actuated, so as to allow the support 5 to pivot. The mounting position of this projection, corresponding to its entering the passage 60 in the collar 51, is therefore different than said rest position and position of use and offset from the aforementioned positions by 90°.

The assembly comprising the support 5, the key bit 7, the push button 19 and the return element 23 forms an insert 5, 7 deployment module. This deployment module is assembled independently of the casing 3.

Assembly of this deployment module involves the following steps (see FIGS. 1*c*, 4*a*, 4*b* and 5*a*):

the end 7*a* of the key bit 7 is fixed to the end 5*a* of the support 5, the return element 23 is introduced through the orifice 6 of the support 5, the first end 23*a* of the return element 23 is fixed into the second lips 39 of the hollow stud 31 of the support 5, the push button 19 is introduced through the orifice 6 and the push button 19 is positioned in such a way as to offer up the retaining projection 49 of the push button 19 over the opening in the collar 51 of the support 5, in the position known as the mounting position, the second end 23*b* of the return element 23 is fixed into the first lips 29 in the interior space 20 of the push button 19, and the retaining projection 49 is introduced into the passage 60 of the collar 51 of the support 5 and the push button 19 is turned through an angle of 90° so that the retaining projection 49 engages in the notch 53B of the collar 51 of the support 5, in what is known as the rest position of the insert.

Furthermore, because the return element 23 is a helical torsion spring, turning the push button 19 until the retaining projection 49 engages with the notch 53 allows the torsion spring to be preloaded in a simple way.

Of course, the order in which some of the steps involved in assembling this deployment module are performed can be altered.

With the deployment module thus assembled it can be mounted in the casing 3. To do that, the support 5 is mounted on the lower half-shell 3*b* and the upper half-shell 3*a* is positioned in such a way that the push button 19 is housed in the housing 21 of the upper half-shell 3*a*, projecting from the casing 3. The two half-shells 3*a*, 3*b* are then fixed together.

The assembly of the insert support or yoke, of the button and of the spring is thus a preassembled unit, with the spring preloaded. This arrangement therefore allows such a module to be prefabricated and produced and delivered by a supplier to the manufacturer of the remote control device.

Thus, when an operator wishes to use the insert 5, 7 and therefore to deploy it from the casing 3, he presses the push button 19, actuation of which releases the retaining projection 49 from the notch 53B of the support 5, thus relaxing the return element 23.

Under the action of the return element 23, the support 5 pivots with respect to the casing 3, the guide fingers of the support 5 being guided by the guide grooves 43*a*, 43*b* made on the casing 3.

Under the effect of the pivoting of the support 5, the key bit 7 is disengaged from the setback 9 and therefore moves from its retracted rest position inside the casing 3, into its position of use in which it is deployed with respect to the casing 3 and in which the key bit 7 can be used, moving through an angle of 180°.

This position of use is reached when the guide fingers of the support 5 come up against the stops 47 of the casing 3, thus preventing any additional movement. In this deployed position, the retaining projection 49 has come into engagement with the notch 53A of the support 5, following a pivoting through 180°.

It will therefore be appreciated that such a deployment module forms a preassembled unit for the key 1 that allows the return element 23 to be loaded easily at the time of assembly and that can be mounted very simply in the casing 3 of the key 1, while at the same time limiting the number of parts needed for articulating the insert 5, 7 with respect to the casing 3.

The invention claimed is:

1. A module for deploying a retractable insert of a key for a motor vehicle, the module configured to be mounted in a casing of said key, and comprising:

an insert configured to be pivot-mounted with respect to said casing between a rest position in which the insert is retracted inside said casing and a position of use in which the insert is deployed with respect to said casing, the insert comprising a key bit and a key bit support secured to the key bit and pivot-mounted with respect to said casing; and an insert deployment mechanism comprising a push button and an elastic return element for returning the insert, the elastic return element comprising a helical torsion spring, wherein a first end of the elastic return element is connected to the insert to urge the insert to pivot toward said position of use when the push button is actuated, wherein the push button comprises at least one guide peg that blocks the rotation of the push button with respect to said casing, and forms a guide for the push button in axial translation, wherein said elastic return element is fixed to said push button by a second end, wherein the first end of said elastic return element is fixed to the key bit support so that said elastic return element urges said support to pivot to deploy the key bit when the push button is actuated, wherein said push button comprises a retaining projection for keeping the insert in the rest position and in the position of use, a position for mounting the retaining projection being different than said rest position and position of use, and wherein said key bit support comprises a collar with an opening through which said retaining projection passes in the mounting position, wherein the collar is recessed below the key bit support.

2. The module as claimed in claim 1, wherein said collar has two notches collaborating with said retaining projection such that said retaining projection engages with one of said two notches in the rest position and with another of said two notches in the position of use, and wherein said retaining projection leaves said notch corresponding to the rest position when the push button is actuated, so as to allow said key bit support to pivot.

3. The module as claimed in claim 1, wherein the push button and said guide-forming rotation-preventing stop pad are produced as a single component.

4. The module as claimed in claim 3, wherein said guide-forming rotation-preventing stop pad comprises at least one guide peg for guiding the push button and configured to collaborate with a corresponding slot of said casing.

5. The module as claimed in claim 1, wherein the push button has a hollow interior space in which the second end of said elastic return element is housed.

6. The module as claimed in claim 1, wherein said key bit support comprises a hollow stud inside which the first end of said elastic return element is housed.

7. The module as claimed in claim 1, wherein the stop pad is further configured to halt the translational movement of the push button, and is housed at least partially in said key bit support.

8. A key for a motor vehicle, equipped with a deployment module as claimed in claim 1, wherein the key comprises said casing comprising an upper half-shell forming a cover and a lower half-shell forming a casing bottom, and said push button housed axially in an associated housing of the upper half-shell and projecting with respect to the upper half-shell so that the push button can be actuated by a user.

9. The key as claimed in claim 8, wherein said key bit support comprises a hollow stud inside which the first end of said elastic return element is housed, wherein said lower half-shell of said casing has a setback to accept said key bit support in said position of rest, and wherein an orifice is made in an internal wall of said lower half-shell in a region of the setback into which to fit said hollow stud.

* * * * *